US011719044B2

(12) United States Patent
Mikalsen et al.

(10) Patent No.: US 11,719,044 B2
(45) Date of Patent: Aug. 8, 2023

(54) ROBOTIC SYSTEM INCLUDING AN ELECTRICAL CLAMPING SYSTEM

(71) Applicant: CANRIG ROBOTIC TECHNOLOGIES AS, Sandnes (NO)

(72) Inventors: Kenneth Mikalsen, Sandnes (NO); Erlend Halvorsen, Sandnes (NO); Svein Søyland, Kvernaland (NO)

(73) Assignee: Canrig Robotic Technologies AS, Sandnes (NO)

( * ) Notice: Subject to any disclaimer, the term of this patent is extended or adjusted under 35 U.S.C. 154(b) by 0 days.

(21) Appl. No.: 17/203,246

(22) Filed: Mar. 16, 2021

(65) Prior Publication Data

US 2021/0293091 A1 Sep. 23, 2021

Related U.S. Application Data

(60) Provisional application No. 62/991,812, filed on Mar. 19, 2020.

(51) Int. Cl.

| | |
|---|---|
| ***E21B 4/04*** | (2006.01) |
| ***E21B 15/02*** | (2006.01) |
| ***E21B 17/00*** | (2006.01) |

(52) U.S. Cl.

CPC ..... *E21B 4/04* (2013.01); *E21B 15/02* (2013.01); *E21B 17/00* (2013.01)

(58) Field of Classification Search

CPC ..... E21B 4/04; E21B 15/02; E21B 17/00

See application file for complete search history.

(56) References Cited

U.S. PATENT DOCUMENTS 6,138,776 A * 10/2000 Hart ..... E21B 19/161 175/85

6,392,322 B1 5/2002 Mares et al.

(Continued)

FOREIGN PATENT DOCUMENTS

BR PI0915190 B1 4/2019
CN 108000556 A 5/2018

(Continued)

OTHER PUBLICATIONS

Dyao Stephen Ogunyale, "Design of Cooling Systems for 6-Axis Welding Robot Drives," HAMK University of Applied Sciences, Degree Programme in Augomation Engineering, Valkeakoski Jan. 2, 2013, 38 pgs.

(Continued)

*Primary Examiner* — Aaron L Lembo

(74) *Attorney, Agent, or Firm* — Abel Schillinger, LLP

(57) ABSTRACT

A robot, robotic systems, and methods for conducting a subterranean operation. In some embodiments, a robot may include: a main body comprising a housing; a powered clamping system; a controlled atmosphere volume disposed within the housing or within the clamping system; and an electrical component disposed within the controlled atmosphere volume. In some embodiments, the controlled atmosphere volume may comprise an EX-certified volume and the electrical component may be disposed within the EX-certified volume, such that the electrical component may be disposed in the EX-certified volume that is disposed in the housing and/or an EX-certified volume that is disposed in the clamping system, such as in an electrically powered tong.

20 Claims, 8 Drawing Sheets

(56) References Cited

U.S. PATENT DOCUMENTS

| | | | | |
|---|---|---|---|---|
| 6,731,091 | B2 | 5/2004 | Hietmann et al. | |
| 7,464,622 | B2 | 12/2008 | Markert et al. | |
| 8,015,890 | B2 | 9/2011 | Christensen et al. | |
| 8,109,370 | B2 | 2/2012 | Yamasaki | |
| 8,495,930 | B2 | 7/2013 | Haughom | |
| 8,777,199 | B2 | 7/2014 | Webb | |
| 9,369,024 | B2 | 6/2016 | Yamasaki et al. | |
| 9,574,648 | B2 | 2/2017 | Ikeda et al. | |
| 9,614,408 | B2 | 4/2017 | Funada | |
| 9,768,662 | B2 | 9/2017 | Urata et al. | |
| 9,890,840 | B2 | 2/2018 | Ohnishi et al. | |
| 10,480,291 | B2 | 11/2019 | Wiedecke et al. | |
| 10,648,545 | B2 | 5/2020 | Mizuuchi | |
| 10,822,891 | B2 * | 11/2020 | Mikalsen | E21B 19/15 |
| 11,085,512 | B2 | 8/2021 | Shimizu | |
| 2004/0051326 | A1 | 3/2004 | Belik | |
| 2004/0231127 | A1 | 11/2004 | Cartsensen | |
| 2004/0237726 | A1 | 12/2004 | Schulze Beckinghausen | |
| 2006/0102697 | A1 | 5/2006 | Nagai et al. | |
| 2007/0074606 | A1 | 4/2007 | Halse | |
| 2008/0277108 | A1 | 11/2008 | Bouligny, Jr. et al. | |
| 2010/0025046 | A1 | 2/2010 | Francis et al. | |
| 2011/0169357 | A1 | 7/2011 | Gieras et al. | |
| 2013/0071218 | A1 | 3/2013 | Hosek et al. | |
| 2014/0305265 | A1 | 10/2014 | Haughom | |
| 2015/0101826 | A1 | 4/2015 | Gupta et al. | |
| 2015/0107850 | A1 | 4/2015 | Mosing et al. | |
| 2015/0252633 | A1 | 9/2015 | Fulks | |
| 2015/0285348 | A1 | 10/2015 | Ikeda et al. | |
| 2016/0338221 | A1 | 11/2016 | Rush et al. | |
| 2016/0340030 | A1 | 11/2016 | Roussey et al. | |
| 2019/0017619 | A1 | 1/2019 | Gagliano et al. | |
| 2019/0136669 | A1 | 5/2019 | Wiedecke et al. | |
| 2019/0137964 | A1 | 5/2019 | Wiedecke et al. | |
| 2019/0309586 | A1 | 10/2019 | Søyland et al. | |
| 2019/0330937 | A1 | 10/2019 | Mikalsen et al. | |
| 2020/0023513 | A1 | 1/2020 | Ha et al. | |
| 2021/0293100 | A1 | 9/2021 | Van Duivendijk et al. | |
| 2021/0293101 | A1 | 9/2021 | Søyland | |
| 2021/0293102 | A1 | 9/2021 | Larsen | |

FOREIGN PATENT DOCUMENTS

| | | | | |
|---|---|---|---|---|
| DE | 102008062430 | B4 | 1/2011 | |
| JP | H05-122890 | A | 5/1993 | |
| MX | 322254 | B | 7/2014 | |
| RU | 2672891 | C2 | 11/2018 | |
| WO | 2005/056975 | A1 | 6/2005 | |
| WO | WO-2005056975 | A1 * | 6/2005 | E21B 19/164 |
| WO | 2005079134 | A2 | 9/2005 | |
| WO | 2006/055467 | A1 | 5/2006 | |
| WO | 2013/040401 | A1 | 3/2013 | |
| WO | 2016/205038 | A1 | 12/2016 | |
| WO | 2019/174691 | A1 | 9/2019 | |

OTHER PUBLICATIONS

Robbie Dickson, "Linear Actuators 101—Everything you need to know about Linear Actuators," Firgelli Automations, Nov. 16, 2018, 19 pgs, https://www.firgelliauto.com/blogs/news/linear-actuators-101.

"Carlos Gonzalez, ""What's the Difference Between Pneumatic, Hydraulic, and Electrical Actuators?"" Machine Design, Apr. 16, 2015, 5 pgs, https://www.machinedesign.com/mechanical-motion-systems/linear-motion/article/21832047/whats-the-difference-between-pneumatic-hydraulic-and-electrical-actuators".

International Search Report from PCT Application No. PCT/EP2021/056936 dated May 31, 2021, 1 pg.

International Search Report from PCT Application No. PCT/EP2021/056939 dated Jun. 28, 2021, 1 pg.

International Search Report from PCT Application No. PCT/EP2021/056938 dated Jul. 23, 2021, 1 pg.

OCTG API 5DP Pipe Specification (https://web.archive.org/web/20180628140443/https://www.mid-continents.com/drill-pipe), Archived Jun. 28, 2018 (Year: 2018).

* cited by examiner

ROBOTIC SYSTEM INCLUDING AN ELECTRICAL CLAMPING SYSTEM

CROSS-REFERENCE TO RELATED APPLICATION(S)

This application claims priority under 35 U.S.C. § 119(e) to U.S. Patent Application No. 62/991,812, entitled "ROBOTIC SYSTEM INCLUDING AN ELECTRICAL CLAMPING SYSTEM," by Kenneth MIKALSEN et al., filed Mar. 19, 2020, which application is assigned to the current assignee hereof and incorporated herein by reference in its entirety.

BACKGROUND

Embodiments of the present disclosure relate generally to systems and methods for conducting subterranean processing operations. More particularly, present embodiments relate to systems and methods regarding EX-certified robotic systems and that include internal cooling systems and that are adapted for accomplishing drilling or mining operations, such as the extraction and processing of water, oil, gas, and minerals.

Safety risks to personnel can be reduced by use of automated systems to conduct subterranean processing operations, particularly where such operations are conducted under hazardous conditions and/or in dangerous locations. A common operation during the drilling of subterranean wells involves assembling tubular strings, such as casing strings and drill strings, each of which comprises a plurality of elongated, heavy tubular segments extending downwardly from a drilling rig into a well bore. The tubular string consists of a number of tubular segments, which threadedly engage one another. Automated tubular (or pipe) handling machines, such as iron roughnecks, automated catwalks, tubular elevators, and pipe handlers, can be installed to operate on and/or near a rig floor to manage (or assist in management of) tubular segments as they are manipulated between storage areas and a wellbore. Such conventional automated tubular handling machines can reduce certain safety risks to personnel, but still suffer various shortcomings.

Therefore, there continues to be a need for improved articles, systems, and methods for conducting subterranean operations.

SUMMARY

A first aspect includes a robot for conducting a subterranean operation comprising: a main body comprising a housing; a powered clamping system; a controlled atmosphere volume disposed within the housing or within the clamping system; and an electrical component disposed within the controlled atmosphere volume. The controlled atmosphere volume may comprise an EX-certified volume. The electrical component may be disposed within the EX-certified volume. The electrical component may be disposed in the EX-certified volume that is disposed in the housing. The electrical component may be disposed in an EX-certified volume that is disposed in the clamping system. The clamping system may comprise an electrically powered clamping system. The electrically powered clamping system may comprise an electrically powered tong. The electrically powered tong may comprise an electrically powered clamp actuator. The electrically powered clamp actuator may comprise an electric motor that is disposed in the EX-certified volume. The electrically powered actuator may include a split-second feedback control of the actuator, such as a decisecond feedback control, a centisecond feedback control, or a millisecond feedback control. The electrically powered tong may comprise a torque wrench system, a make-up tong system, or a combination thereof. The torque wrench system may be adapted to clamp onto a tubular member at a set clamping pressure and rotate the tubular member at a set torque. The torque wrench system may be adapted to rotate the tubular at a controlled set speed. The torque wrench system may be adapted to increase the clamping pressure as a higher torque is applied to the tubular member. The torque wrench system may further comprise a die coupled to the clamping actuator, wherein the torque wrench system is adapted to monitor and control the position of the die, such as the vertical position, horizontal position, rotational position, or combinations thereof.

BRIEF DESCRIPTION OF THE DRAWINGS

The present disclosure can be better understood, and its numerous features and advantages made apparent to those skilled in the art by referencing the accompanying drawings.

The use of the same reference symbols in different drawings indicates similar or identical items.

DETAILED DESCRIPTION

Figure 1:
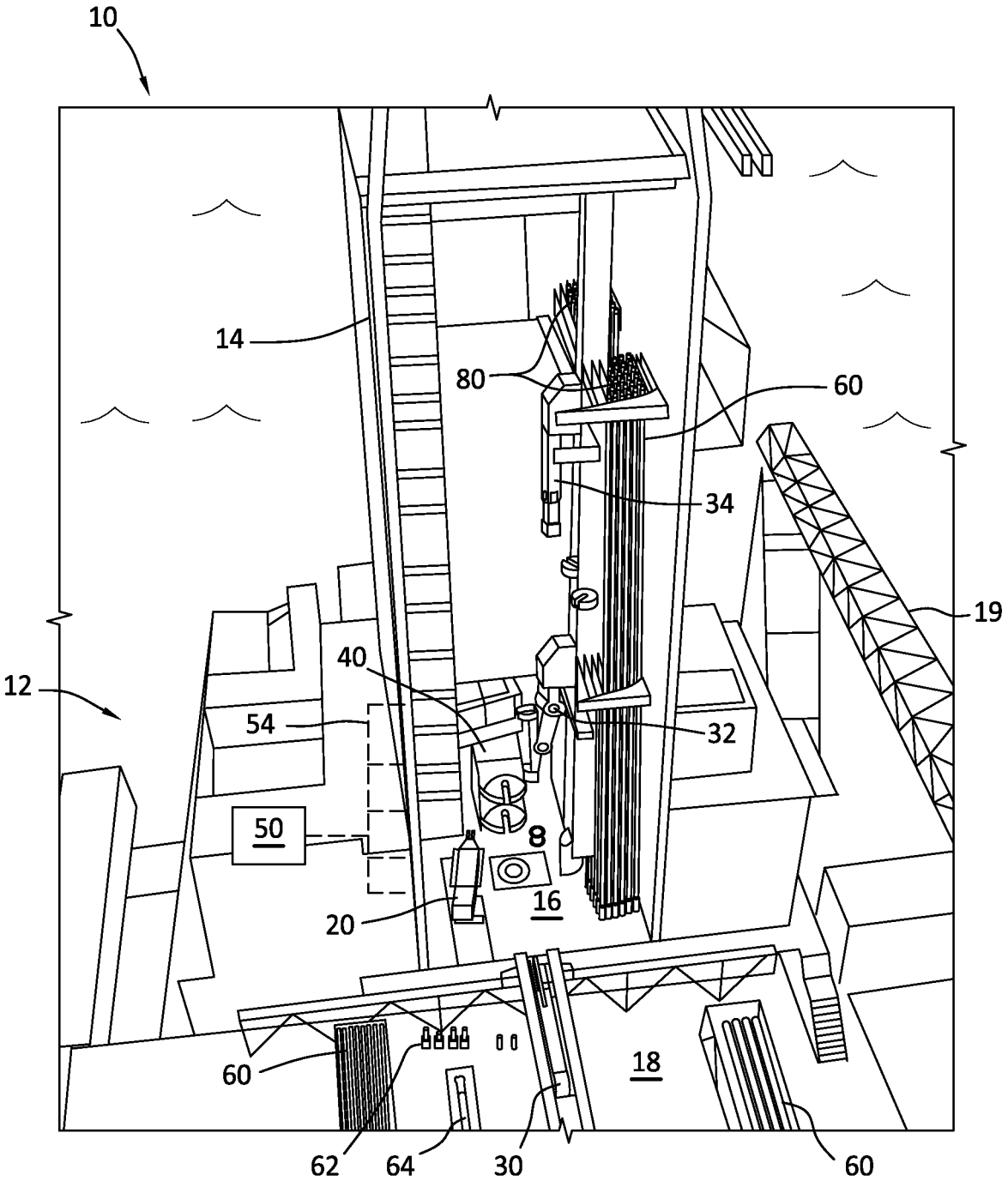
FIG. 1 is a representative view of a rig that can be used to perform subterranean operations, in accordance with certain embodiments.

The following description, in combination with the figures, is provided to assist in understanding the teachings disclosed herein. The following discussion will focus on specific implementations and embodiments of the teachings. This discussion is provided to assist in describing the teachings and should not be interpreted as a limitation on the scope or applicability of the teachings.

The term "averaged," when referring to a value, is intended to mean an average, a geometric mean, or a median value. As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. As used herein, the phrase "consists essentially of" or "consisting essentially of" means that the subject that the phrase describes does not include any other components that substantially affect the property of the subject.

Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Further, references to values stated in ranges include each and every value within that range. When the terms "about" or "approximately" precede a numerical value, such as when describing a numerical range, it is intended that the exact numerical value is also included. For example, a numerical range beginning at "about 25" is intended to also include a range that begins at exactly 25. Moreover, it will be appreciated that references to values stated as "at least about," "greater than," "less than," or "not greater than" can include a range of any minimum or maximum value noted therein.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and can be found in textbooks and other sources within the mining, drilling, and robotics arts.

Present embodiments provide a robot, robotic systems, and methods for conducting a subterranean operation. In some embodiments, a robot may include a hazardous atmosphere controlled area or volume, such as an EX-certified chamber, that is located within the body of the robot. In some embodiments, a robot may include a cooling system that is at least partially disposed to fully disposed within the body of the robot, such as partially to fully disposed within the chamber located within the body.

FIG. 1 is a representative view of a rig 10 that can be used to perform subterranean operations. The rig 10 is shown as an offshore rig, but it should be understood that the principles of this disclosure are equally applicable to onshore rigs as well. The example rig 10 can include a platform 12 with a derrick 14 extending above the platform 12 from the rig floor 16. The platform 12 and derrick 14 provide the general super structure of the rig 10 from which the rig equipment is supported. The rig 10 can include a horizontal storage area 18, pipe handlers 30, 32, 34, a drill floor robot 20, an iron roughneck 40, a crane 19, and fingerboards 80. The equipment on the rig 10, can be communicatively coupled to a rig controller 50 via a network 54, with the network 54 being wired or wirelessly connected to the equipment.

Some of the equipment that can be used during subterranean operations is shown in the horizontal storage area 18 and the fingerboards 80, such as the tubulars 60, the tools 62, and the bottom hole assembly (BHA) 64. The tubulars 60 can include drilling tubular segments, casing tubular segments, and tubular stands that are made up of multiple tubular segments. The tools 62 can include centralizers, subs, slips, adapters, etc. The BHA 64 can include drill collars, instrumentation, and a drill bit.

Figure 2:
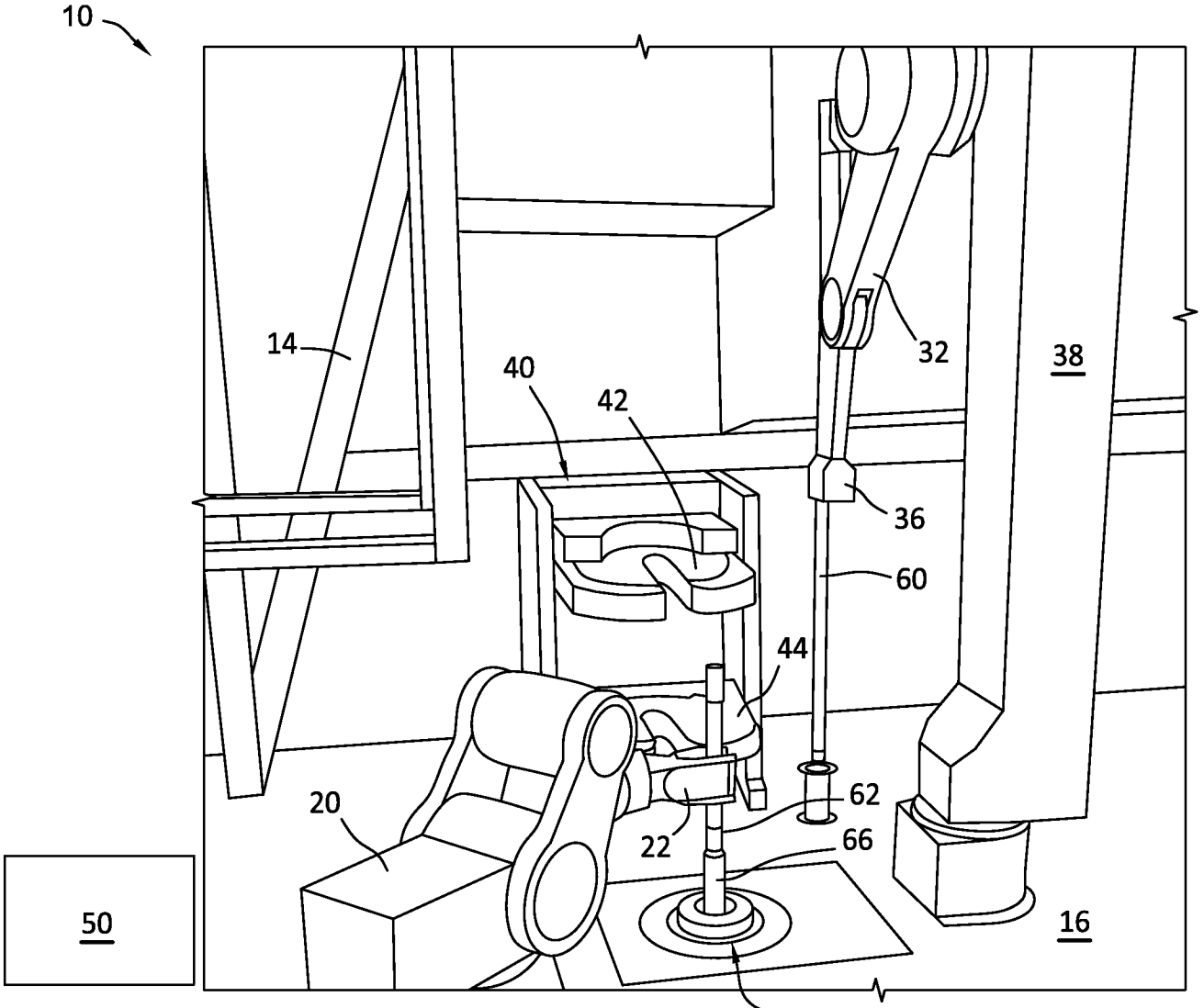
FIG. 2 is representative perspective view of robots that can be used on a drill floor of a rig during subterranean operations, in accordance with certain embodiments.

FIG. 2 is representative perspective view of some robots that can be used on a drill floor 16 of a rig 10 during subterranean operations. FIG. 2 shows a drill floor robot 20 gripping a tool 62 at the top end of the tubular string 66. One end of the tool 62 that engages the tubular string 66 can be seen as a second tool joint of the tubular string 66, with the top end of the tubular string 66 being seen as the first tool joint of the tubular string. The iron roughneck 40 can engage the first tool joint via the backup tong 44 and engage the second tool joint via the torque wrench 42, with the torque wrench 42 applying a predetermined torque to the second tool joint to make-up or break out a connection between the first and second tool joints. The gripper 22 can engage the tool 62 and spin it off the top of the tubular string 66 in preparation for installing a tubular 60 to the end of the tubular string 66. The pipe handler 32 can engage a tubular 60 with the grippers 36 and move the tubular 60 from a storage location or the pipe handler 30 to a well center 82 where the pipe handler 32 can thread the tubular 60 onto the tubular string 66. The iron roughneck 40 can then torque the joint via torque wrench 42 and backup tong 44.

When tripping the tubular string 66 from the wellbore, the iron roughneck 40 can be used to break lose the joint via the wrenches 42, 44. The drill floor robot 20 (or other transport means, such as a mobile cart, robotic arm attached to drill floor 16, etc.) can also be used to move a mud bucket 100 between a storage location and a deployed location. For example, the gripper 22 of the drill floor robot 20 can be removed and the drill floor robot 20 connected, via tool interface, to a mud bucket 100 for collecting expelled fluid when a tubular joint is disconnected.

Figure 3:
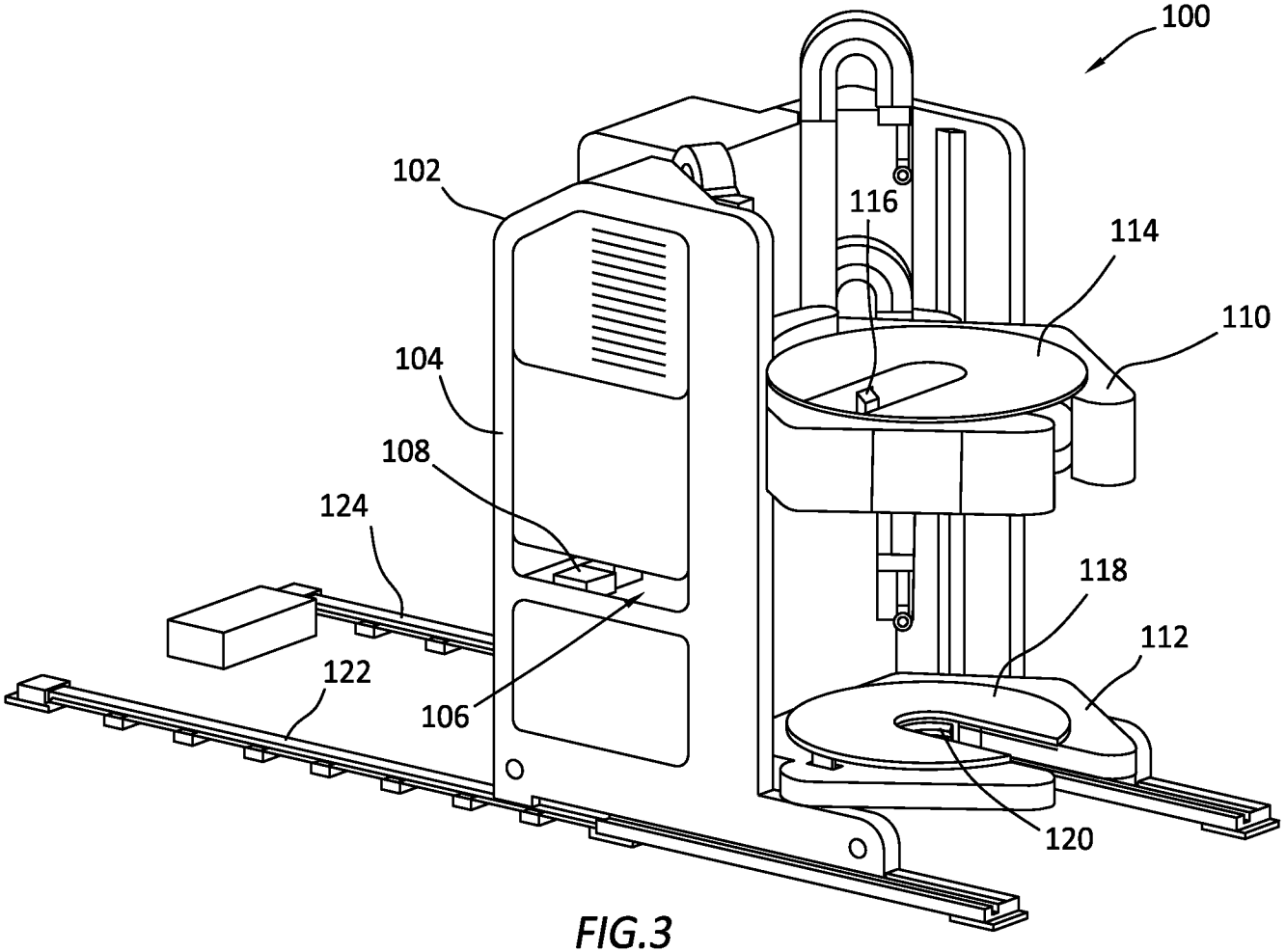
FIG. 3 is an illustration of an embodiment of a robot for conducting a subterranean operation that includes a controlled atmosphere volume disposed within a main body comprising a housing or within the clamping system; and an electrical component disposed within the controlled atmosphere volume.

FIG. 3 shows an embodiment of a robot 100 (e.g., iron roughneck) for conducting a subterranean operation comprising a central body 102 with a housing 104. An EX-certified chamber 106, which may be externally accessible and resealable, is disposed within the central body. One or more electrical components 108 can be disposed within the EX-certified chamber 106. The robot 100 may further comprise a first tubular manipulation tool 110 or a second tubular manipulation tool 112 that are moveably attached to the central body 102. The first tubular manipulation tool 110 may comprise a powered tong, such as a torque wrench, that may include a rotation table 114 and clamps 116. The second tubular manipulation tool 112 may comprise a powered tong, such as a backup tong, that can include a rotation table 118 and clamps 120. The robot may further comprise a horizontal movement element, such as a first rail 122 or second rail 124, upon which the central body is moveably attached. It should be understood that that rotation table 118 may be configured to rotate with respect to the housing 104, but it can also be configured to be rotationally fixed to the housing 104 such that the rotation table 118 does not rotate relative to the housing 104.

Figure 4:
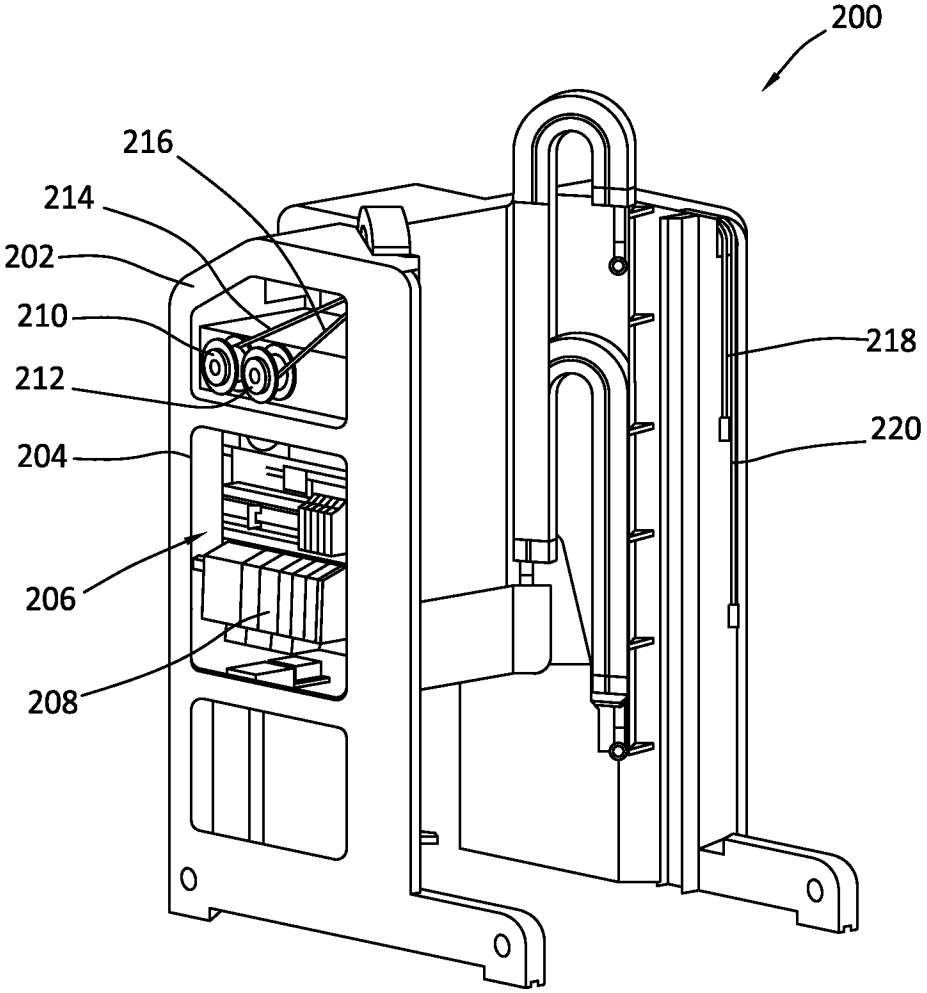
FIG. 4 is an illustration of an embodiment of a robot for conducting a subterranean operation that includes a plurality of electrical components disposed within a resealable EX-certified chamber that is located within the robot.

FIG. 4 shows an embodiment of a robot 200 for conducting a subterranean operation comprising a central body 202 with a housing 204 and an EX-certified chamber 206 that is disposed within the central body. The EX-certified chamber 206 may be externally accessible and resealable. One or more electrical components 208 can be disposed within the EX-certified chamber 106. The robot 200 may further comprise a vertical movement system adapted to accomplish independent vertical movement of a first tubular manipulation tool (e.g., tool 110 in FIG. 1). In a specific embodiment, the vertical movement system may comprise a winch 210 connected to a flexible member 214 and another winch on an opposite side of robot 200 connected to a flexible member 218, and can provide for independent vertical movement of the first tubular manipulation tool (e.g., tool 110 in FIG. 1). In certain embodiments, the flexible members may comprise cables, belts, chains, wires, or a combination thereof. The vertical movement system may comprise additional vertical movement elements, such as a winch 212 connected to a flexible member 216 and another winch on an opposite side of robot 200 connected to a flexible member 220, and can provide for independent vertical movement of the second tubular manipulation tool (e.g., tool 112 in FIG. 1).

Figure 5:
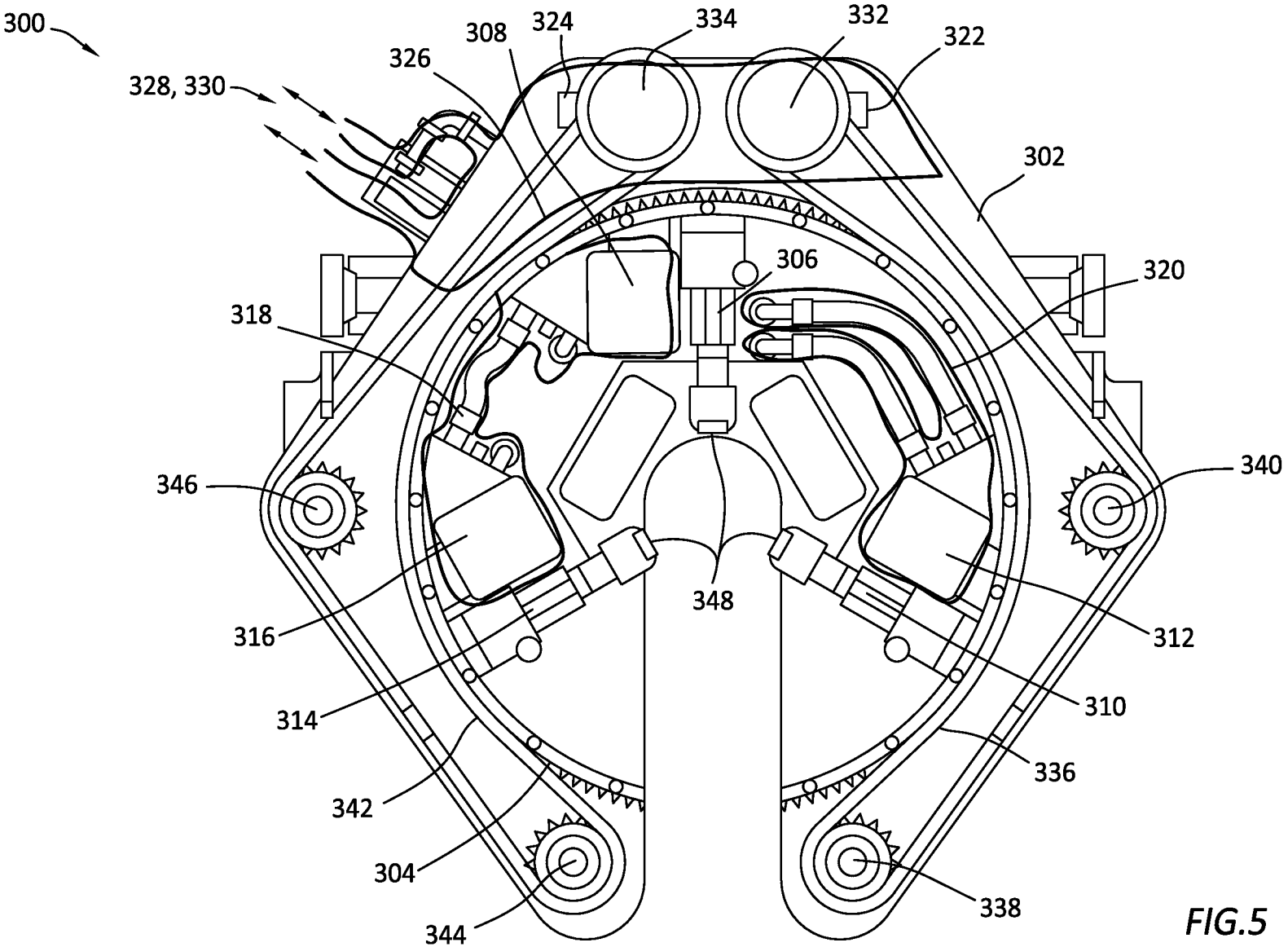
FIG. 5 is an illustration of an embodiment of an electrically powered tong comprising a torque wrench system that includes a purged area disposed within a turntable of the powered tong.

FIG. 5 shows an embodiment of an electrically powered tong 300 comprising a torque wrench system. The torque wrench system comprises a housing 302 and a turntable 304 disposed in the housing. Disposed in the turntable are a first actuator 306 having a first actuator motor 308, a second actuator 310 having a second actuator motor 312, and a third actuator 314 having a third actuator motor 316. The first actuator motor 308 and the third actuator motor are disposed in a first controlled atmosphere volume 318 ("purged" area) comprising an EX-certified atmosphere and/or EX-certified chamber. The first controlled atmosphere volume 318 includes portions of the actuator housings that contain the electric motors and that are in fluid communication via protected tubing. The second actuator motor 312 is disposed in a second controlled atmosphere volume 320 ("purged" area) comprising an EX-certified atmosphere and/or EX-certified chamber. The second controlled atmosphere volume 320 includes a portion of the actuator housing that contains the electric motor and that is in fluid communication with protected tubing. The first controlled atmosphere volume 318 is in fluid communication with the second controlled atmosphere volume 320. A first drive motor 322 and a second drive motor 324 for driving the rotation of the rotation table are disposed within a third controlled atmosphere volume 326 ("purged" area) comprising an EX-certified atmosphere and/or EX-certified chamber. The third controlled atmosphere volume 326 is in fluid communication via inlet/outlet 328, inlet/outlet 330, and protective tubing (not shown) with a controlled atmosphere volume (not shown) that is located within the main body of the robot and that comprises an EX-certified atmosphere and EX-certified chamber. The third controlled atmosphere volume 326 is also in fluid communication with the first controlled atmosphere volume 318 and second controlled atmosphere volume 320. A first drive gear 332 is coupled to the first drive motor 322 and a second drive gear 334 is coupled to the second drive motor 324. A first drive chain 336 is engaged with the first drive gear 332, a first idler gear 338, a second idler gear 340, and with a portion of an outer edge of the rotation table 304. A second drive chain 342 is engaged with the second drive gear 334, a third idler gear 344, a fourth idler gear 346, and with a portion of an outer edge of the rotation table 304. A first die, a second die, and a third die 348 are disposed on a clamping end of the first actuator 306, the second actuator 310, and the third actuator 314, respectively. The actuators are electrical linear actuators.

Figure 6:
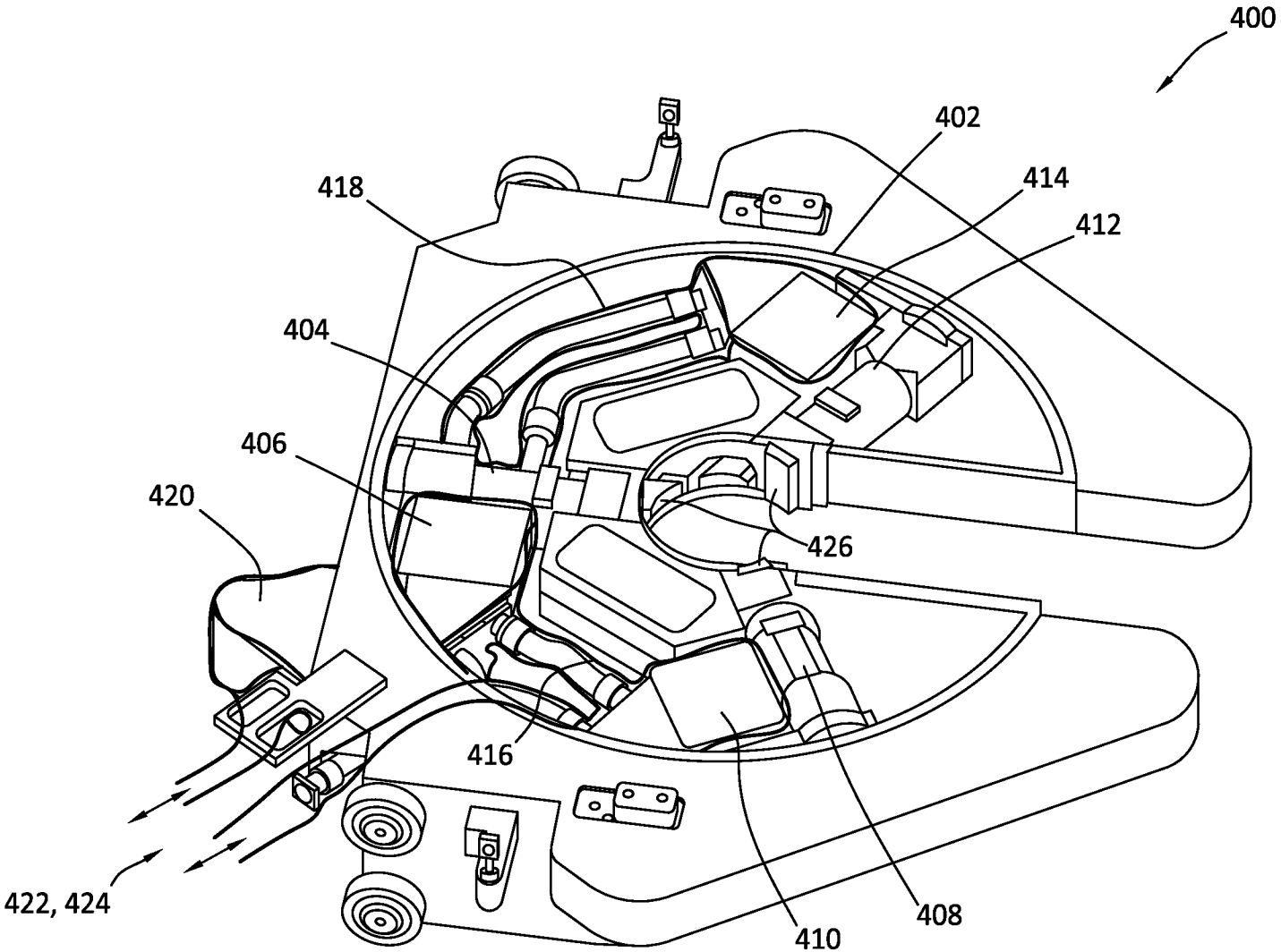
FIG. 6 is an illustration of an embodiment of a powered tong comprising a backup tong system that includes a purged area disposed within the powered tong.

FIG. 6 shows an embodiment of an electrically powered tong 400 comprising a backup tong system. The backup tong system comprises a housing 402. Disposed in the housing are a first actuator 404 having a first actuator motor 406, a second actuator 408 having a second actuator motor 410, and a third actuator 412 having a third actuator motor 414. The first actuator motor 406 and the second actuator motor 410 are disposed in a first controlled atmosphere volume 416 ("purged" area) comprising an EX-certified atmosphere and/or EX-certified chamber. The first controlled atmosphere volume 416 includes portions of the actuator housings that contain the electric motors and that are in fluid communication via protected tubing. The third actuator motor 414 is disposed in a second controlled atmosphere volume 418 ("purged" area) comprising an EX-certified atmosphere and/or EX-certified chamber. The second controlled atmosphere volume 418 includes a portion of the actuator housing that contains the electric motor and that is in fluid communication with protected tubing. The first controlled atmosphere volume 416 is in fluid communication with the second controlled atmosphere volume 418. A third controlled atmosphere volume 420 ("purged" area) comprising an EX-certified atmosphere and/or EX-certified chamber is in fluid communication via inlet/outlet 422, inlet/outlet 424, and protective tubing (not shown) with a controlled atmosphere volume (not shown) that is located within the main body of the robot and that comprises an EX-certified atmosphere and an EX-certified chamber. The third controlled atmosphere volume 420 is also in fluid communication with the first controlled atmosphere volume 416 and second controlled atmosphere volume 418. A first die, a second die, and a third die 426 are disposed on a clamping end of the first actuator 404, the second actuator 408, and the third actuator 412, respectively. The actuators are electrical linear actuators.

Figure 7:
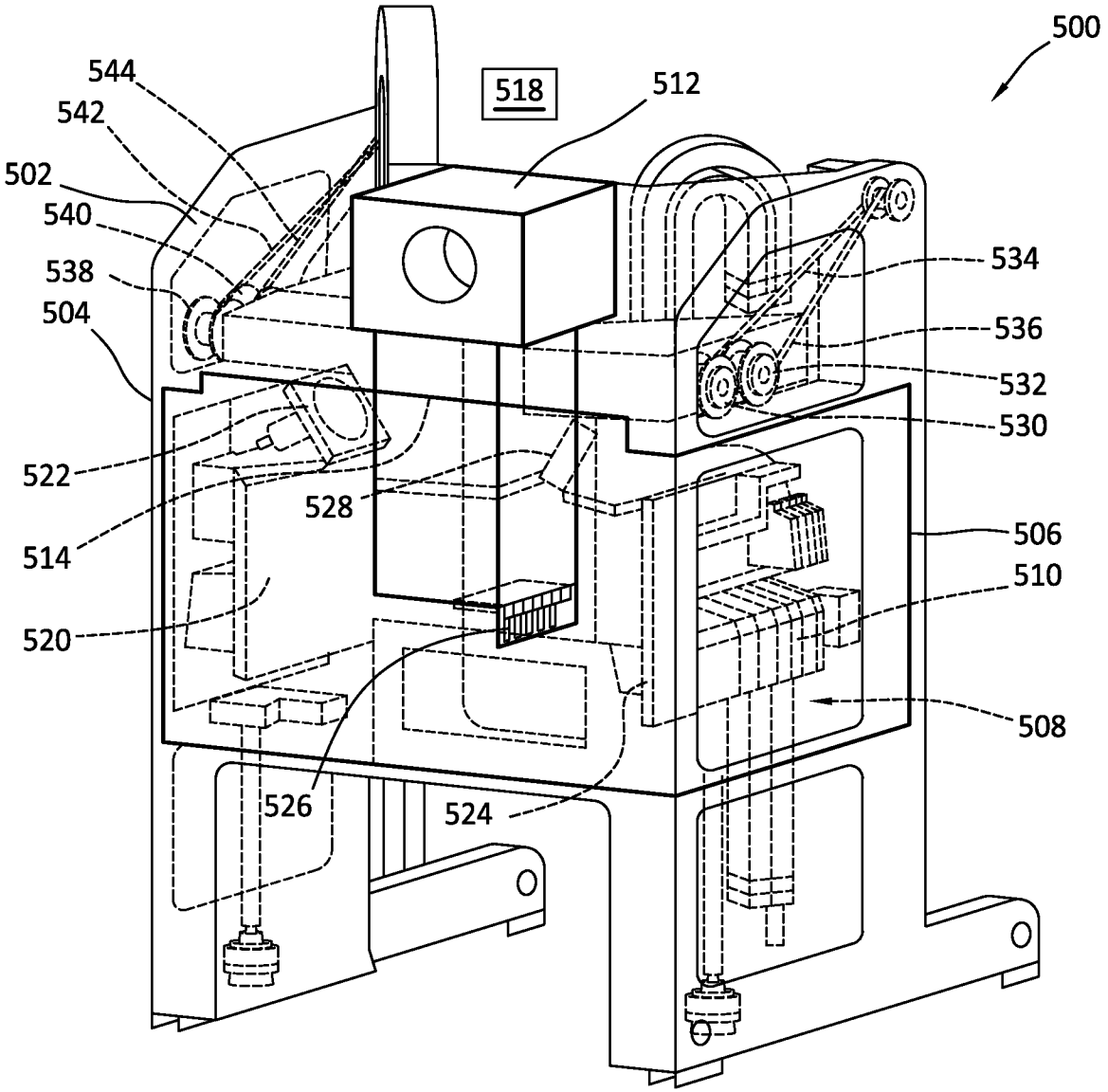
FIG. 7 is an illustration of an embodiment of a robot for conducting a subterranean operation that includes a controlled atmosphere volume disposed within a main body comprising a housing and an electrical component disposed within the controlled atmosphere volume.

FIG. 7 shows an embodiment of a robot 500 for conducting a subterranean operation comprising a central body 502 comprising a housing 504. Disposed within the central body 502 is a controlled atmosphere volume 506. The controlled atmosphere volume may comprise an EX-certified chamber 508. The EX-certified chamber may be integral with the housing 504. The EX-certified chamber may be externally accessible and resealable. A one or more electrical components 510 may be disposed within the EX-certified chamber. At least a portion of a cooling system is disposed within the controlled atmosphere volume 506, such as in an EX-certified chamber, located within a body of the robot. In a specific embodiment, a cooling unit 512 is partially disposed within the controlled atmosphere volume 506 comprising an EX-certified chamber, such that the cooling unit traverses a boundary 514 between the controlled atmosphere volume 506 ("purged" area) and a non-controlled atmosphere volume 518 ("non-purged" area).

Also disposed within the EX-certified chamber are other components of the cooling system, including: a first cold plate 520; a first fluid circulation loop comprising a first cool fluid line (not shown) and a first hot fluid line (not shown); a first fan 522, a second cold plate 524; a second fluid circulation loop comprising a second cool fluid line (not shown) and a second hot fluid line (not shown), a second fan 528, or a combination thereof. In a specific embodiment, the first fluid circulation loop (i.e., the first cool fluid line and the first hot fluid line) may be attached to a manifold 526 disposed on the cooling unit 512. The first fan 522 and second fan 528 may be disposed within the EX-certified chamber so as to promote circulation of air over the cold plates 520, 524. One or more of the electrical components 510 may be disposed in contact with the cold plate 524.

The robot 500 may further comprise a vertical movement system adapted to accomplish independent vertical movement of a first tubular manipulation tool (e.g., tool 112 in FIG. 1). In a specific embodiment, the vertical movement system may comprise a pair of winches 530, 538 connected to a respective flexible member 534, 542, and can provide for independent vertical movement of the first tubular manipulation tool (e.g., tool 110 in FIG. 1). In certain embodiments, the flexible members may comprise cables, belts, chains, wires, or a combination thereof. The vertical movement system may comprise additional vertical movement elements, such as a pair of winches 532, 540 connected to a respective flexible member 536, 544, and can provide for independent vertical movement of the first tubular manipulation tool (e.g., tool 110 in FIG. 1).

Figure 8:
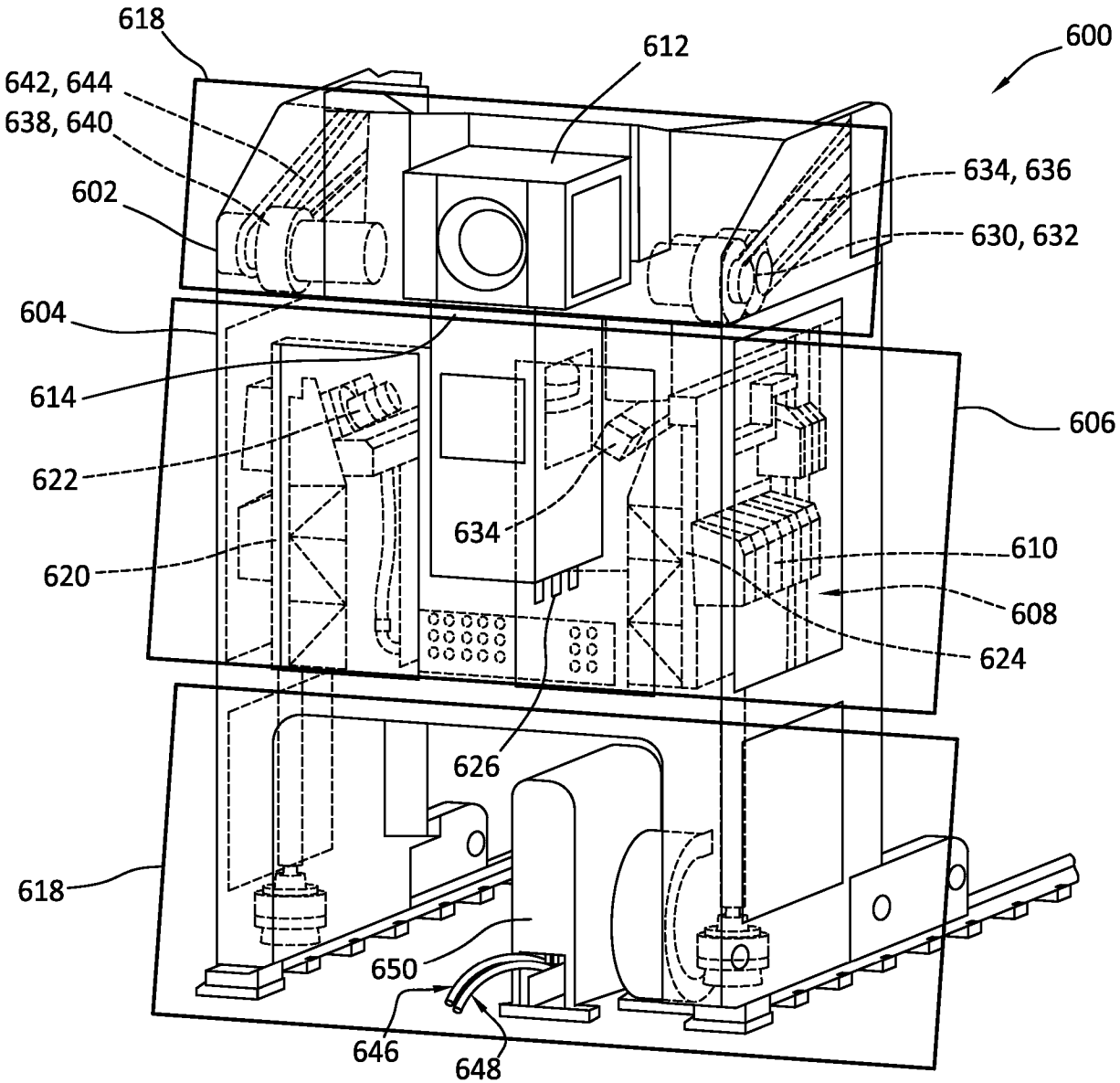
FIG. 8 is an image of another embodiment of a robot for conducting a subterranean operation that includes a controlled atmosphere volume disposed within a main body comprising a housing and an electrical component disposed within the controlled atmosphere volume.

FIG. 8 shows an embodiment of a robot 600 for conducting a subterranean operation comprising a central body 602 comprising a housing 604. Disposed within the central body 602 is a controlled atmosphere volume 606. The controlled atmosphere volume may comprise an EX-certified chamber 608. The EX-certified chamber may be integral with the housing 604. The EX-certified chamber may be externally accessible and resealable. A one or more electrical components 610 may be disposed within the EX-certified chamber. At least a portion of a cooling system is disposed within the controlled atmosphere volume 606, such as in an EX-certified chamber, located within a body of the robot.

In a specific embodiment, a cooling unit 612 is partially disposed within the controlled atmosphere volume 606 comprising an EX-certified chamber, such that the cooling unit traverses a boundary 614 between the controlled atmosphere volume 606 ("purged" area) and a non-controlled atmosphere volume 618 ("non-purged" area). Also disposed within the EX-certified chamber can be other components of the cooling system, including: a first cold plate 620; a first fluid circulation loop comprising a first cool fluid line (not shown, see previous example) and a first hot fluid line (not shown, see previous example); a first fan 622, a second cold plate 624; a second fluid circulation loop comprising a second cool fluid line (not shown, see previous example) and a second hot fluid line (not shown, see previous example), and a second fan 628. The first fluid circulation loop (i.e., the first cool fluid line (not shown, see previous example) and the first hot fluid line (not shown, see previous example) may be attached to a manifold 626 disposed on the cooling unit 612. External input fluid line 648 and external output fluid line 646 may be connected to junction box 650. An input fluid line (not shown, see previous example) and an output fluid line (not shown, see previous example) may be connected to the cooling unit 612 by attachment to manifold 636. The fans 622, 628 may be disposed within the EX-certified chamber 106 so as to promote circulation of air over the cold plates 620, 624. One or more of the electrical components 610 may be disposed in contact with the cold plate 620.

The robot 600 may further comprise a vertical movement system adapted to accomplish independent vertical movement of a first tubular manipulation tool (e.g., tool 112 in FIG. 1). In a specific embodiment, the vertical movement system may comprise a pair of winches 630, 638 connected to a respective flexible member 634, 642, and can provide for independent vertical movement of the first tubular manipulation tool (e.g., tool 110 in FIG. 1). In certain embodiments, the flexible members may comprise cables, belts, chains, wires, or a combination thereof. The vertical movement system may comprise additional vertical movement elements, such as a pair of winches 632, 640 connected to a respective flexible member 636, 644, and can provide for independent vertical movement of the first tubular manipulation tool (e.g., tool 110 in FIG. 1).

Housing

The robot (e.g., 100, 200, 500, 600) may comprise a body (e.g., 102, also referred to herein as a "central body" or "main body"). The central body may comprise a housing (e.g., 104, also referred to herein as a "chassis"). The housing is adapted to enclose an internal component of the robot within the body of the robot. The housing may enclose one or more spaces, volumes, cavities, chambers, or a combination thereof. The one or more spaces, volumes, cavities, chambers, or a combination thereof may be integral with the housing, separate from the housing, or a combination thereof. The housing may comprise a cover, a covering, a shell, a container, an enclosure, a framework (i.e., "frame"), or a combination thereof.

The housing may be comprised of materials or combinations of materials that are suitable for the robot to safely operate in a hazardous environment. Hazardous environments include flammable environments, explosive environments, corrosive environments, or a combination thereof.

Controlled Atmosphere/Non-Controlled Atmosphere

The robot may comprise a controlled atmosphere volume. As used herein a "controlled atmosphere volume" (also referred to herein as a "purged volume" or "purged area") will be understood to refer to a volume of space within the body of the robot, such as a specific area within the robot, where the atmosphere is controlled to reduce the risk of fire, explosion, corrosion, or a combination thereof. The controlled atmosphere volume may comprise an atmosphere that has a reduced risk of explosion. The reduced risk can meet an accepted standard, such as the ATEX and IECEx standards for hazardous areas. The controlled atmosphere volume may comprise an atmosphere conforming to the ATEX or IECEx standards for hazardous areas (also referred to herein as an "EX-certified" atmosphere).

EX-Certified Chamber

The robot may comprise an EX-certified chamber disposed within the body of the robot, such as within the housing of the robot. As referred to herein, an EX-certified chamber refers to a specified volume within the body of the robot, such as in a specified space, volume, cavity, chamber, or a combination thereof, that contains an atmosphere having a reduced hazard risk meeting the ATEX and IECEx standards for hazardous areas. ATEX is an abbreviation for "Atmosphere Explosible". IECEx stands for the certification by the International Electrotechnical Commission for Explosive Atmospheres. In other words, a volume or chamber within the robot containing an explosive (EX)-certified atmosphere and capable of containing an EX-certified atmosphere is an EX-certified chamber. In a specific embodiment, an EX-certified chamber comprises an EX Zone 1 compliant device according to an ATEX certification, an IECEx certification, or a combination thereof.

Two standards (ATEX and IECEx) are generally synonymous with each other and provide guidelines (or directives)

for equipment design. Each standard identifies groupings of multiple EX zones to indicate various levels of hazardous conditions in a target area.

One grouping is for areas with hazardous gas, vapor, or mist concentrations.

EX Zone 0—A place in which an explosive atmosphere consisting of a mixture with air of dangerous substances in the form of gas, vapor or mist is present continuously or for long periods or frequently.

EX Zone 1—A place in which an explosive atmosphere consisting of a mixture with air of dangerous substances in the form of gas, vapor or mist is likely to occur in normal operation occasionally.

EX Zone 2—A place in which an explosive atmosphere consisting of a mixture with air of dangerous substances in the form of gas, vapor or mist is not likely to occur in normal operation but, if it does occur, will persist for a short period only.

Another grouping is for areas with hazardous powder or dust concentrations.

EX Zone 20—A place in which an explosive atmosphere in the form of a cloud of combustible dust in air is present continuously, or for long periods or frequently.

EX Zone 21—A place in which an explosive atmosphere in the form of a cloud of combustible dust in air is likely to occur in normal operation occasionally.

EX Zone 22—A place in which an explosive atmosphere in the form of a cloud of combustible dust in air is not likely to occur in normal operation but, if it does occur, will persist for a short period only.

The Zone normally associated with the oil and gas industry is the EX Zone 1. Therefore, the explosive atmosphere directives or guidelines for robotic systems used in subterranean operations can be for an EX Zone 1 environment. Explosive atmosphere directives or guidelines for other EX Zones can be used also (e.g., EX Zone 21). However, the EX Zone 1 and possibly EX Zone 21 seem to be the most applicable explosive atmosphere directives or guidelines for the oil and gas industry. ATEX is the name commonly given to two European Directives for controlling explosive atmospheres:

1) Directive 99/92/EC (also known as 'ATEX 137' or the 'ATEX Workplace Directive') on minimum requirements for improving the health and safety protection of workers potentially at risk from explosive atmospheres; and 2) Directive 94/9/EC (also known as 'ATEX 95' or 'the ATEX Equipment Directive') on the approximation of the laws of Member States concerning equipment and protective systems intended for use in potentially explosive atmospheres.

Therefore, as used herein "ATEX certified" indicates that the article (such as an elevator or pipe handling robot) meets the requirements of the two stated directives ATEX 137 and ATEX 95 for EX Zone 1 environments. IECEx is a voluntary system which provides an internationally accepted means of proving compliance with IEC standards. IEC standards are used in many national approval schemes and as such, IECEx certification can be used to support national compliance, negating the need in most cases for additional testing. Therefore, as used herein, "IECEx certified" indicates that the article (such as an elevator or pipe handling robotic system) meets the requirements defined in the IEC standards for EX Zone 1 environments. As used herein, "EX Zone 1 certified (or certification)" refers to ATEX certification, IECEx certification, or both for EX Zone 1 environments.

Robotic systems tend to not have electrical equipment positioned in the hazardous zones because of the increased probability of sparking due to voltage potentials. Instead, electrical equipment or components such as used in the robotic systems are generally placed outside of the hazardous zone while mechanical equipment under hydraulic control operates within the hazardous zone.

An additional concern for equipment operating within the hazardous zone is corrosion. If a robotic system includes electrical equipment operating within the hazardous zone, corrosion of the equipment can further increase sparking potential by exposing parts of the equipment that were properly protected when the equipment was first deployed, as well as causing direct or indirect damage to the electrical components of the system.

Electrical Components

The robot may include an electrical component, or a plurality of electrical components, that can be disposed within the body of the robot (e.g., disposed within the controlled atmosphere volume). The electrical component may include a controller that controls a function of the robot. In a specific embodiment, the controller may include an electronic controller. An electrical component may include an electric motor, an electrical actuator, an electrical switch, an electronic controller, a microprocessor, a programmable logic device, a programmable logic controller (PLC), a relay, a resistor, a capacitor, an inductor, a switch, a memory device, a network interface component (optical, electrical, etc.), an energy convertor, a printed circuit board (PCB), PCB mountable components, optical interface devices, electrical wiring, and combinations thereof. An electrical component may include a PLC, a remote controller, an input-output (I/O) device, a transceiver, an antenna, a printed circuit board, a computer processing unit (CPU), a cable connection, a computer-readable medium, or a combination thereof. A computer readable medium may include any suitable memory for storing instruction, such as read-only memory (ROM), random access memory (RAM), flash memory, an electrically erasable programmable ROM (EEPROM), or a combination thereof.

Cooling System

A robot for conducting a subterranean operation may include a cooling system disposed within the robot. The cooling system may be disposed fully or partially within the robot, such as partially or fully within a housing of the robot, or partially or fully within an EX-certified chamber within the robot. At least a portion of the cooling system can be disposed within the EX-certified chamber. In a specific embodiment, a cooling unit may be partially disposed within a controlled atmosphere volume, such as an EX-certified chamber, wherein the cooling unit can traverse a boundary between the controlled atmosphere volume ("purged" area) and a non-controlled atmosphere volume ("non-purged" area).

The cooling system may include: a cooling unit, a cold plate; a fluid circulation loop comprising a cool fluid line and a hot fluid line, a fan, or a combination thereof. The cooling system may include a second cold plate; a second fluid circulation loop comprising a second cool fluid line and a second hot fluid line, and a second fan, or a combination thereof. The cooling unit may include a manifold adapted to connect to the first fluid circulation loop or second fluid circulation loop to first cold plate or the second cold plate. The fan or fans may be disposed so as to promote circulation of air over one or both of the cold plates. A fan or fans may be disposed or adapted so as to purge the atmosphere within the controlled atmosphere volume, such as at a specific rate. A first fan or a second fan may be disposed within the controlled atmosphere volume so as to promote circulation of air over a first cold plate and a second cold plate, respectively, as well as to purge the atmosphere within the controlled atmosphere volume. A fan may be disposed in the controlled atmosphere volume in proximity to, or even within, the portion of the cooling unit that is disposed within the controlled atmosphere volume so that it is adapted to promote circulation of air over a radiator of the cooling unit. One or more of the electrical components as described herein may be disposed in contact with at least one cold plate.

The cooling system may include a fluid cooling system, such as a chilling system or a refrigeration system. A fluid cooling system may include a cooling unit, a coolant, a compressor, a condenser, an evaporator, a coolant pump, a refrigerant, a radiator, a manifold, a cold plate, or a combination thereof. The coolant, the compressor, the condenser, the evaporator, the coolant pump, the refrigerant, the radiator, the manifold, the cold plate, or a combination thereof can be disposed within the EX-certified chamber. The cold plate is disposed in contact with an electrical component (e.g., a printed circuit board PCB). The coolant can flow through the manifold, the cold plate, or a combination thereof. The coolant flows through the manifold and the cold plate. The coolant may include a suitable fluid, such as water, ethylene glycol, or a combinations thereof. The fluid cooling system may further include a dew-point sensor, a temperature sensor, a pressure sensor, or a combination thereof. The cooling system may include a continuous water chiller system.

The cooling system may have a specific cooling capacity. The cooling system may have a cooling capacity of at least 0.5 kilowatts (kW), such as at least 1 kW, at least 3 kW, at least 5 kW, at least 7 kW, at least 9 kW, or at least 11 kW. The cooling system may have a cooling capacity of not greater than 100 kilowatts (kW), such as not greater than 80 kW, not greater than 60 kW, not greater than 40 kW, or not greater than 20 kW. The cooling capacity can be within a range comprising any pair of the previous upper and lower limits. The cooling capacity may include not less than 0.5 kW to not greater than 100 kW, such as not less than 1 kW to not greater than 80 kW.

The cooling system may be attached to and provide cooling to a second robot, such as an additional robot for conducting a subterranean operation. A first robot for conducting a subterranean operation can include a cooling system that is disposed within the first robot and coupled to a second robot (which can support conducting a subterranean operation), wherein the cooling system provides cooling to the first robot or the second robot. In a specific embodiment, such as shown in FIGS. 1 and 2, the first robot may be an iron roughneck 40, the second robot may be a drill floor robot 20, a pipe handler 30, 32, 34, or a combination thereof. The second robot is separate and distinct from the first robot, except that they can be coupled via power and cooling lines.

Where a second robot is attached, the cooling system may provide a specific percentage of cooling capacity for the second robot. The cooling system may provide cooling capacity for a second robot in an amount of not less than 1%, such as not less than 3%, not less than 5%, not less than 10%, not less than 20%, not less than 25%, or not less than 30%. The cooling system may provide cooling capacity for a second robot in an amount of not greater than 60%, such as not greater than 50%, not greater than 45%, not greater than 40%, not greater than 30%, or not greater than 25%. The amount of cooling capacity can be a range comprising any pair of the previous upper and lower limits. In a particular embodiment, the cooling system may provide cooling capacity for a second robot in an amount of not less than 1% to not greater than 50%.

Tubular Manipulation System

The robot may comprise an automated tubular manipulation system, (also called herein a tubular manipulation tool). The automated tubular manipulation system may comprise a powered clamping system. A controlled atmosphere volume may be disposed within a housing of the automated tubular manipulation system, within the powered clamping system, or a combination thereof. In a specific embodiment, an electrical component may be disposed in an EX-certified volume that is disposed in the powered clamping system. In an embodiment, the powered clamping system comprises an electrically powered clamping system.

In a specific embodiment, the automated tubular manipulation system may comprise a tong, an automated torque wrench, an automated backup tong, an automated gripper, an automated spinner, an automated clamp, an automated pipe handler, an automated tubular handler, or a combination thereof.

Powered Tong

The electrically powered clamping system may comprise an electrically powered tong or a plurality of powered tongs. The electrically powered tong may comprise an electrically powered clamp actuator. An electrically powered clamp actuator comprises an electric motor that is disposed in an EX-certified volume.

The electrically powered actuator may beneficially include a feedback sensor, a feedback control (controller), or a combination thereof. A feedback control can comprise a split-second feedback control of the actuator, such as a decisecond feedback control, a centisecond feedback control, or a millisecond feedback control.

The electrically powered tong may comprise a torque wrench system, a make-up tong system, or a combination thereof.

Torque Wrench System

The robot may comprise a torque wrench system. The torque wrench system may be adapted to clamp onto a tubular member at a set clamping pressure and rotate the tubular member at a set torque. The torque wrench system may be adapted to rotate a tubular member at a controlled set speed (i.e., at a constant speed), such as to avoid sudden, and potentially damaging, rapid rotation of a tubular member when breaking down or making up strings of tubular members. A torque wrench system may be adapted to increase the clamping pressure as a higher torque is applied to the tubular member, which can beneficially prevent slippage. A torque wrench system may further comprise a die coupled to each of a plurality of clamping actuators, wherein the torque wrench system can be adapted to monitor and control the position of each die, such as control and monitor the vertical position, horizontal position, rotational position, or combinations thereof.

The torque wrench system may comprise: a rotation table, a first drive motor, a first drive gear, and a first drive chain or a first drive belt. The rotation table is coupled to a first drive chain. The first drive chain is disposed along and engaged with a portion of an outer circumference of the rotation table.

The amount the first drive chain is disposed along and engaged with the rotation table may vary. The first drive chain can be disposed along and engaged with the rotation table at least 5%, such as at least 10%, at least 15%, at least 20%, at least 25% at least 30%, at least 35%, or at least 40% of the outer circumference of the rotation table. The first drive chain is disposed along and engaged with the rotation table not greater than 90%, such as not greater than 80%, not greater than 70%, not greater than 60%, or not greater than 50%. The amount of engagement can be within a range comprising any pair of the previous upper and lower limits. In a particular embodiment, the engagement comprises not less than 20% to not greater than 75%, such as not less than 35% to not greater than 60%.

The first drive chain is adapted to evenly apply torque along the outer circumference of the rotation table where the first drive chain is engaged with the rotation table.

The torque wrench system may further include a tightening system comprising a chain tightening system, a belt tightening system, or a combination thereof. The tightening system may comprise an eccentric tightening system.

The torque wrench system may further include a second drive chain or a second drive belt. The properties of the second drive chain or a second drive belt may be the same as or different than the first drive chain or the first drive belt. In a specific embodiment, the properties of the second drive chain are the same as the first drive chain. The rotation table may be coupled to a second drive chain.

The second drive chain may be disposed along and engaged with a beneficial portion of the outer circumference of the rotation table on an opposite side of the rotation table from the first drive chain. The second drive chain can be disposed along and engaged with at least 5%, such as at least 10%, at least 15%, at least 20%, at least 25% at least 30%, at least 35%, or at least 40% of the outer circumference of the rotation table. The second drive chain can be disposed along and engaged with the rotation table not greater than 90%, such as not greater than 80%, not greater than 70%, not greater than 60%, or not greater than 50%. The amount of engagement can be within a range comprising any pair of the previous upper and lower limits. In a particular embodiment, the engagement comprises not less than 20% to not greater than 75%, such as not less than 35% to not greater than 60%.

Backup Tong System

The robot may comprise a backup tong system (also called herein a "backup tong"). The backup tong system can comprise an electrically powered tong.

The backup tong system may be adapted to clamp onto a tubular member at a set clamping pressure. The backup tong system may be adapted to increase the clamping pressure as a higher torque is applied to the tubular member. The backup tong system may further comprise a die coupled to each of a plurality of clamping actuators, and wherein the backup tong system is adapted to monitor and control the position of each die, such as the vertical position, horizontal position, rotational position, or combinations thereof.

The robot may further comprise a second electrically powered tong. The second electrically powered tong may be the same or different than the first electrically powered tong. The second electrically powered tong may comprise a torque wrench system, a backup tong, or a combination thereof.

Tong Elevation System

The robot may comprise a vertical movement system adapted to accomplish independent vertical movement of a powered clamping system, such as an electrically powered tong. In an embodiment, the vertical movement system comprises a tong elevation system adapted to accomplish independent vertical movement of a first electrically powered tong, a second electrically powered tong, or a combination thereof. A first electrically powered tong, a second electrically powered tong, or a combination thereof can be coupled to the tong elevation system.

In a specific embodiment, the tong elevation system is adapted to independently control a vertical position (also called herein the "height") of the first electrically powered tong, the second electrically powered tong, or a combination thereof. The tong elevation system may comprise a first winch system and a second winch system. The first winch system can control the vertical position of the first electrically powered tong. The second winch system can control the vertical position of the second electrically powered tong.

The tong elevation system may beneficially comprise a safety release system adapted to sense whether a tubular member that is disposed in the first electrically powered tong, the second electrically powered tong, or a combination thereof is being pulled away from said first electrically powered tong, second electrically powered tong, or a combination thereof, such as being pulled or pushed vertically away, being pulled or pushed horizontally away, being twisted away, being rotated away, or a combination thereof.

Electro-Mechanical Robot

A robot for conducting a subterranean operation may be a substantially (i.e., greater than 90%) to completely (i.e., 100%) electro-mechanically controlled system, a substantially (i.e., greater than 90%) to completely (i.e., 100%) electro-mechanically powered system, or a combination thereof. The robot can include a completely electro-mechanically powered system. As used herein, substantially to completely electro-mechanically controlled or substantially to completely electro-mechanically powered means that the robot functions are substantially (i.e., greater than 90%) to completely (i.e., 100%) controlled or powered without the use of a hydraulic system connected to the robot. The robot can be a substantially to completely electrically powered motor system. The robot can be a substantially to completely electrically powered actuator system.

Types of Robot

The robot may include a particular type of robot for accomplishing a particular type of subterranean operation or a combination of subterranean operations. The robot may include an iron roughneck, a drill floor robot, a multi-size elevator, a pipe handler, a tubular handler, a racking system, or a combination thereof.

EMBODIMENTS

Embodiment 1. A robot for conducting a subterranean operation comprising:

a main body comprising a housing;

a powered clamping system;

a controlled atmosphere volume disposed within the housing or within the clamping system; and an electrical component disposed within the controlled atmosphere volume.

Embodiment 2. The robot of embodiment 1, wherein the controlled atmosphere volume comprises an EX-certified volume.

Embodiment 3. The robot of embodiment 2, wherein the electrical component is disposed within the EX-certified volume.

Embodiment 4. The robot of embodiment 3, wherein the electrical component is disposed in an EX-certified volume that is disposed in the housing.

Embodiment 5. The robot of embodiment 3, wherein the electrical component is disposed in an EX-certified volume that is disposed in the clamping system.

Embodiment 6. The robot of embodiment 5, wherein the clamping system comprises an electrically powered clamping system.

Embodiment 7. The robot of embodiment 6, wherein the electrically powered clamping system comprises an electrically powered tong.

Embodiment 8. The robot of embodiment 7, wherein the electrically powered tong comprises an electrically powered clamp actuator.

Embodiment 9. The robot of embodiment 8, wherein the electrically powered clamp actuator comprises an electric motor that is disposed in the EX-certified volume.

Embodiment 10. The robot of embodiment 9, wherein the electrically powered actuator includes a split-second feedback control of the actuator, such as a decisecond feedback control, a centisecond feedback control, or a millisecond feedback control.

Embodiment 11. The robot of embodiment 10, wherein the electrically powered tong comprises a torque wrench system, a make-up tong system, or a combination thereof.

Embodiment 12. The robot of embodiment 11, wherein the torque wrench system is adapted to clamp onto a tubular member at a set clamping pressure and rotate the tubular member at a set torque.

Embodiment 13. The robot of embodiment 12, wherein the torque wrench system is adapted to rotate the tubular at a controlled set speed.

Embodiment 14. The robot of embodiment 13, wherein the torque wrench system is adapted to increase the clamping pressure as a higher torque is applied to the tubular member.

Embodiment 15. The robot of embodiment 14, wherein the torque wrench system further comprises a die coupled to the clamping actuator, and wherein the torque wrench system is adapted to monitor and control the position of the die, such as the vertical position, horizontal position, rotational position, or combinations thereof.

Embodiment 16. The robot of embodiment 13, wherein the torque wrench system comprises: a rotation table, a first drive motor, a first drive gear, and a first drive chain or a first drive belt.

Embodiment 17. The robot of embodiment 16, wherein the rotation table is coupled to a first drive chain.

Embodiment 18. The robot of embodiment 17, wherein the first drive chain is disposed along and engaged with a portion of an outer circumference of the rotation table.

Embodiment 19. The robot of embodiment 18, wherein the first drive chain is disposed along and engaged with at least 5%, such as at least 10%, at least 15%, at least 20%, at least 25% at least 30%, at least 35%, or at least 40% of the outer circumference of the rotation table.

Embodiment 20. The robot of embodiment 19, wherein the first drive chain is adapted to evenly apply torque along the outer circumference of the rotation table where the first drive chain is engaged with the rotation table.

Embodiment 21. The robot of embodiment 20, wherein the torque wrench system further includes a tightening system comprising a chain tightening system, a belt tightening system, or a combination thereof.

Embodiment 22. The robot of embodiment 21, wherein the tightening system comprises an excentric tightening system.

Embodiment 23. The robot of embodiment 16, wherein rotation system further includes a second drive chain or a second drive belt.

Embodiment 24. The robot of embodiment 23, wherein the rotation table is coupled to the second drive chain.

Embodiment 25. The robot of embodiment 24, wherein the second drive chain is disposed along and engaged with a portion of the outer circumference of the rotation table.

Embodiment 26. The robot of embodiment 25, wherein the second drive chain is disposed along and engaged with at least 5%, such as at least 10%, at least 15%, at least 20%, at least 25% at least 30%, at least 35%, or at least 40% of the outer circumference of the rotation table.

Embodiment 27. The robot of embodiment 26, wherein the second drive chain is adapted to evenly apply torque along the outer circumference of the rotation table where the second drive chain is engaged with the rotation table.

Embodiment 28. The robot of embodiment 11, wherein the electrically powered tong comprises a backup tong system.

Embodiment 29. The robot of embodiment 28, wherein the backup tong system is adapted to clamp onto a tubular member at a set clamping pressure.

Embodiment 30. The robot of embodiment 29, wherein the backup tong system is adapted to increase the clamping pressure as a higher torque is applied to the tubular member.

Embodiment 31. The robot of embodiment 30, wherein the backup tong system further comprises a die coupled to the clamping actuator, and wherein the backup tong system is adapted to monitor and control the position of the die, such as the vertical position, horizontal position, rotational position, or combinations thereof.

Embodiment 32. The robot of embodiment 7, further comprising a second electrically powered tong.

Embodiment 33. The robot of embodiment 32, wherein the first electrically powered tong, the second electrically powered tong, or a combination thereof is coupled to a tong elevation system.

Embodiment 34. The robot of embodiment 33, wherein the tong elevation system is adapted to independently control a vertical position (height) of the first electrically powered tong, the second electrically powered tong, or a combination thereof.

Embodiment 35. The robot of embodiment 34, wherein the tong elevation system comprises a first winch system, a second winch system, or a combination thereof.

Embodiment 36. The robot of embodiment 35, wherein the first winch system controls the vertical position of the first electrically powered tong.

Embodiment 37. The robot of embodiment 35, wherein the second winch system controls the vertical position of the second electrically powered tong.

Embodiment 38. The robot of embodiment 35, wherein the tong elevation system comprises a safety release system adapted to sense whether a tubular member disposed in the first electrically powered tong, the second electrically powered tong, or a combination thereof is being pulled away from said first electrically powered tong, second electrically powered tong, or a combination thereof, such as being pulled or pushed vertically away, being pulled or pushed horizontally away, being twisted away, being rotated away, or a combination thereof.

Embodiment 39. The robot of embodiment 1, wherein the electrical component comprises an electric motor, an electrical actuator, an electrical switch, an electronic controller, a microprocessor, a programmable logic device, a programmable logic controller (PLC), a relay, a resistor, a capacitor, an inductor, a switch, a memory device, a network interface component, an energy convertor, a printed circuit board (PCB), a PCB mountable component, an optical interface device, an electrical wiring, or a combination thereof.

Embodiment 40. The robot of embodiment 38, wherein an embodiment, electrical component comprise a PLC, a remote controller, an input-output (I/O) device, a transceiver, an antenna, a printed circuit board, a computer processing unit (CPU), a cable connection, a computer-readable medium, or a combination thereof.

Embodiment 41. The robot of embodiment 39, wherein the electronic controller controls a function of the robot.

Embodiment 42. The robot of embodiment 1, further comprising a motor disposed within the controlled atmosphere volume.

Embodiment 43. The robot of embodiment 1, wherein the robot comprises a substantially electro-mechanically controlled system, a substantially electro-mechanically powered system, or a combination thereof.

Embodiment 44. The robot of embodiment 43, wherein the robot comprises a completely electro-mechanically controlled system, a completely electro-mechanically powered system, or a combination thereof.

Embodiment 45. The robot of embodiment 43, wherein the robot comprises a completely electrically powered motor system, a completely electrically powered actuator system, or a combination thereof.

Embodiment 46. The robot of embodiment 2, wherein the controlled atmosphere volume comprises an EX-certified chamber.

Embodiment 47. The robot of embodiment 46, wherein the EX-certified chamber comprises an EX Zone 1 compliant device according to an ATEX certification, an IECEx certification, or a combination thereof.

Embodiment 48. The robot of embodiment 1, further comprising cooling system disposed in the housing, wherein the cooling system comprises a cooling unit and a heat sink.

Embodiment 49. The robot of embodiment 1, wherein the robot comprises an automated torque wrench, an automated backup tong, an automated gripper, an automated spinner, an automated clamp, an automated pipe handler, an automated tubular handler, or a combination thereof.

Embodiment 50. The robot of embodiment 1, wherein the robot comprises an iron roughneck, a drill floor robot, a multi-size elevator, a pipe handler, a tubular handler, a racking system, or a combination thereof.

Embodiment 51. A robot for conducting a subterranean operation, the robot comprising:

a main body coupled to a rig and comprising a housing;

a first clamping system;

a controlled atmosphere volume disposed within at least one of the housing, the first clamping system, and a combination thereof; and an electrical component disposed within the controlled atmosphere volume.

Embodiment 52. The robot of embodiment 51, wherein the controlled atmosphere volume comprises an EX-certified volume disposed in the first clamping system, and wherein the electrical component is disposed within the EX-certified volume.

Embodiment 53. The robot of embodiment 52, wherein the first clamping system comprises a clamp actuator, and wherein the clamp actuator comprising an electric motor disposed in the EX-certified volume.

Embodiment 54. The robot of embodiment 53, wherein the clamp actuator includes a split-second feedback control of the clamp actuator, and wherein the split-second feedback control comprises at least one of a decisecond feedback control, a centisecond feedback control, and a millisecond feedback control.

Embodiment 55. The robot of embodiment 54, wherein the first clamping system comprises a torque wrench system, and wherein the torque wrench system is adapted to clamp onto a tubular member at a predetermined clamping pressure and rotate the tubular member at a predetermined torque and speed.

Embodiment 56. The robot of embodiment 55, wherein the torque wrench system further comprises a die coupled to the clamp actuator, and wherein the die is configured to engage a tubular when the clamp actuator is extended toward the tubular.

Embodiment 57. The robot of embodiment 55, wherein the torque wrench system comprises: a rotation table, a first drive motor, a first drive gear, and a first drive chain, and wherein the rotation table is coupled to the first drive chain.

Embodiment 58. The robot of embodiment 57, wherein the first drive chain is disposed along and engaged with a portion of an outer circumference of the rotation table, and wherein the first drive chain is adapted to evenly apply torque along the portion of the outer circumference of the rotation table where the first drive chain is engaged with the rotation table.

Embodiment 59. The robot of embodiment 58, wherein rotation system further includes a second drive motor, a second drive gear, and a second drive chain, and wherein the rotation table is coupled to the second drive chain.

Embodiment 60. The robot of embodiment 59, wherein the second drive chain is disposed along and engaged with a second portion of the outer circumference of the rotation table, and wherein the second drive chain is adapted to evenly apply torque along the second portion of the outer circumference of the rotation table where the second drive chain is engaged with the rotation table.

Embodiment 61. The robot of embodiment 53, further comprising a second clamping system; and a tong elevation system comprising a first winch system and a second winch system, wherein the first winch system controls a vertical position of the first clamping system, and the second winch system controls a vertical position of the second clamping system.

Embodiment 62. The robot of embodiment 61, wherein the tong elevation system comprises a safety release system adapted to sense whether a tubular member is being moved away from the first clamping system, the second clamping system, or a combination thereof and release the tubular member when movement away from the first clamping system, the second clamping system, or a combination thereof is detected.

Embodiment 63. The robot of embodiment 51, wherein the electrical component comprises an electronic controller that controls a function of the robot.

Embodiment 64. The robot of embodiment 51, further comprising a motor disposed within the controlled atmosphere volume.

Embodiment 65. The robot of embodiment 51, wherein the controlled atmosphere volume contains an EX Zone 1 compliant device according to an ATEX certification, an IECEx certification, or a combination thereof.

Embodiment 66. A method of conducting a subterranean operation, the method comprising:

positioning a tubular string within a vertical opening through an iron roughneck, the iron roughneck comprising a first clamping system with a first EX certified volume contained therein and a second clamping system with a second EX certified volume contained therein, wherein a first electrical component is disposed within the first EX certified volume and a second electrical component is disposed within the second EX certified volume; and controlling at least a portion of the iron roughneck, via at least one of the first electrical component and the second electric component, thereby vertically adjusting the first clamping system to a vertical position that is aligned to a first tool joint of the tubular string and actuating the first clamping system to engage the first tool joint.

Embodiment 67. The method of embodiment 66, further comprising purging the first EX certified volume by flowing a gas through the first EX certified volume at a predetermined flow rate.

Embodiment 68. The method of embodiment 67, further comprising controlling at least a portion of the iron roughneck, via at least one of the first electrical component and the second electric component, thereby vertically adjusting the second clamping system to a vertical position that is aligned to a second tool joint of the tubular string and actuating the second clamping system to engage the second tool joint.

Embodiment 69. The method of embodiment 68, further comprising rotating the second clamping system relative to the first clamping system to apply a predetermined torque to the tubular string.

Embodiment 70. The method of embodiment 69, wherein rotating the second clamping system comprises:

engaging a first drive chain and a second drive chain to an outer circumference of a rotation table, with the rotation table containing a plurality of clamping actuators each with a tubular engaging die; and rotating the rotation table by driving the first drive chain and the second drive chain, thereby rotating the second tool joint via engagement of the tubular engaging die with the second tool joint.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Moreover, not all of the activities described above in the general description or the examples are required, that a portion of a specific activity cannot be required, and that one or more further activities can be performed in addition to those described. Still further, the order in which activities are listed is not necessarily the order in which they are performed.

The disclosure is submitted with the understanding that it will not be used to limit the scope or meaning of the claims. In addition, in the foregoing disclosure, certain features that are, for clarity, described herein in the context of separate embodiments, can also be provided in combination in a single embodiment. Conversely, various features that are, for brevity, described in the context of a single embodiment, can also be provided separately or in any subcombination. Still, inventive subject matter can be directed to less than all features of any of the disclosed embodiments.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

Thus, to the maximum extent allowed by law, the scope of the present invention is to be determined by the broadest permissible interpretation of the following claims and their equivalents, and shall not be restricted or limited by the foregoing detailed description.

What is claimed is:

1. A robot for conducting a subterranean operation, the robot comprising:

a main body coupled to a rig and comprising a housing;

a first clamping system;

a second clamping system, wherein the first clamping system is vertically adjustable relative to the second clamping system and the rig, and wherein the second clamping system is vertically adjustable relative to the first clamping system and the rig;

a first controlled atmosphere volume disposed within at least one of the housing, the first clamping system, and a combination thereof, with a first motor disposed within the first controlled atmosphere volume;

a second controlled atmosphere volume disposed within at least one of the housing, the first clamping system, and a combination thereof, with a second motor disposed within the second controlled atmosphere volume, wherein the first controlled atmosphere volume is in fluid communication with the second controlled atmosphere volume; and an electrical component disposed within the first controlled atmosphere volume.

2. The robot of claim 1, wherein the first controlled atmosphere volume comprises a purged volume disposed in the first clamping system, and wherein the electrical component is disposed within the purged volume.

3. The robot of claim 2, wherein the first clamping system comprises a clamp actuator, and wherein the clamp actuator comprising an electric motor disposed in the purged volume.

4. The robot of claim 3, wherein the clamp actuator includes a split-second feedback control of the clamp actuator, and wherein the split-second feedback control comprises at least one of a decisecond feedback control, a centisecond feedback control, and a millisecond feedback control.

5. The robot of claim 4, wherein the first clamping system comprises a torque wrench system, and wherein the torque wrench system is adapted to clamp onto a tubular member at a predetermined clamping pressure and rotate the tubular member at a predetermined torque and speed.

6. The robot of claim 5, wherein the torque wrench system further comprises a die coupled to the clamp actuator, and wherein the die is configured to engage a tubular when the clamp actuator is extended toward the tubular.

7. The robot of claim 3, further comprising a tong elevation system comprising a first winch system and a second winch system, wherein the first winch system controls a vertical position of the first clamping system, and the second winch system controls a vertical position of the second clamping system.

8. The robot of claim 7, wherein the tong elevation system comprises a safety release system adapted to sense whether a tubular member is being moved away from the first clamping system, the second clamping system, or a combination thereof and release the tubular member when movement away from the first clamping system, the second clamping system, or a combination thereof is detected.

9. The robot of claim 1, wherein the electrical component comprises an electronic controller that controls a function of the robot.

10. The robot of claim 1, further comprising a motor disposed within the first controlled atmosphere volume.

11. The robot of claim 1, wherein the first controlled atmosphere volume contains an EX Zone 1 compliant device according to an ATEX certification, an IECEx certification, or a combination thereof.

12. A robot for conducting a subterranean operation, the robot comprising:

a main body coupled to a rig and comprising a housing;

a first clamping system;

a controlled atmosphere volume disposed within at least one of the housing, the first clamping system, and a combination thereof; and an electrical component disposed within the controlled atmosphere volume, wherein the controlled atmosphere volume comprises a purged volume disposed in the first clamping system, and wherein the electrical component is disposed within the purged volume, wherein the first clamping system comprises a clamp actuator, and wherein the clamp actuator comprising an electric motor disposed in the purged volume, wherein the clamp actuator includes a split-second feedback control of the clamp actuator, and wherein the split-second feedback control comprises at least one of a decisecond feedback control, a centisecond feedback control, and a millisecond feedback control, wherein the first clamping system comprises a torque wrench system, wherein the torque wrench system is adapted to clamp onto a tubular member at a redetermined clamping pressure and rotate the tubular member at a predetermined torque and speed, and wherein the torque wrench system comprises: a rotation table, a first drive motor, a first drive gear, and a first drive chain, and wherein the rotation table is coupled to the first drive chain.

13. The robot of claim 12, wherein the first drive chain is disposed along and engaged with a portion of an outer circumference of the rotation table, and wherein the first drive chain is adapted to evenly apply torque along the portion of the outer circumference of the rotation table where the first drive chain is engaged with the rotation table.

14. The robot of claim 13, wherein rotation system further includes a second drive motor, a second drive gear, and a second drive chain, and wherein the rotation table is coupled to the second drive chain.

15. The robot of claim 14, wherein the second drive chain is disposed along and engaged with a second portion of the outer circumference of the rotation table, and wherein the second drive chain is adapted to evenly apply torque along the second portion of the outer circumference of the rotation table where the second drive chain is engaged with the rotation table.

16. A method of conducting a subterranean operation, the method comprising:

positioning a tubular string within a vertical opening through an iron roughneck, the iron roughneck comprising a first clamping system with a first purged volume contained therein and a second clamping system with a second purged volume contained therein, wherein a first electrical component is disposed within the first purged volume and a second electrical component is disposed within the second purged volume; and controlling at least a portion of the iron roughneck, via at least one of the first electrical component and the second electric component, thereby vertically adjusting the first clamping system to a vertical position that is aligned to a first tool joint of the tubular string and actuating the first clamping system to engage the first tool joint;

engaging a first drive chain and a second drive chain to an outer circumference of a rotation table of the second clamping system, with the rotation table containing a plurality of clamping actuators each with a tubular engaging die; and rotating the rotation table of the second clamping system by driving the first drive chain and the second drive chain.

17. The method of claim 16, further comprising purging the first purged volume by flowing a gas through the first purged volume at a predetermined flow rate.

18. The method of claim 17, further comprising controlling at least a portion of the iron roughneck, via at least one of the first electrical component and the second electric component, thereby vertically adjusting the second clamping system to a vertical position that is aligned to a second tool joint of the tubular string and actuating the second clamping system to engage the second tool joint.

19. The method of claim 18, further comprising rotating the second clamping system relative to the first clamping system to apply a predetermined torque to the tubular string.

20. The method of claim 19, wherein rotating the second clamping system comprises:

rotating the second tool joint via engagement of the tubular engaging die with the second tool joint.

* * * * *